US005268811A

United States Patent [19]

Maeda

[11] Patent Number: 5,268,811

[45] Date of Patent: Dec. 7, 1993

[54] METHOD OF CONTROLLING AND CONTROLLER FOR A REFRIGERATOR

[75] Inventor: Masahiko Maeda, Osaka, Japan

[73] Assignee: Kabushiki Kaisha Toshiba, Kawasaki, Japan

[21] Appl. No.: 803,730

[22] Filed: Dec. 9, 1991

Related U.S. Application Data

[63] Continuation of Ser. No. 357,014, May 25, 1989, abandoned.

[30] Foreign Application Priority Data

May 27, 1988 [JP] Japan ..... 63-130898

[51] Int. Cl.[5] ..... H01H 47/00; E05B 47/00

[52] U.S. Cl. ..... 361/172; 70/280; 361/187; 361/191

[58] Field of Search ..... 361/152-156, 361/160, 166, 167, 168.1, 169.1, 170-172, 189-191, 194-198, 205, 210, 187; 340/825.31, 825.32; 70/264, 278-283; 62/125, 265

[56] References Cited

U.S. PATENT DOCUMENTS 3,926,021 12/1975 Genest et al. ..... 70/278
3,953,769 4/1976 Sopko ..... 361/155 X
4,148,092 4/1979 Martin ..... 361/172
4,495,540 1/1985 Remington et al. ..... 361/172
4,558,391 12/1985 Ward et al. ..... 361/155
4,716,490 12/1987 Alexanian ..... 361/155
4,742,426 5/1988 Lavelle ..... 361/171
4,755,799 7/1988 Romano ..... 340/543

FOREIGN PATENT DOCUMENTS 59-12671 4/1984 Japan .

*Primary Examiner*—A. D. Pellinen
*Assistant Examiner*—F. M. Fleming
*Attorney, Agent, or Firm*—Cushman, Darby & Cushman

[57] ABSTRACT

A refrigerator controller which can positively lock and unlock a door thereof in accordance with a command signal from a host-computer connected therewith. The refrigerator controller includes a power supply voltage indicating device. A DC power supply is charged by a DC power source and energizes a door lock mechanism activating device to lock and unlock the door. DC voltage generated by the DC power supply rises as it is charged by the DC power source. The door lock mechanism activating device can be energized to positively lock and unlock the door by being fed with a predetermined lower limit voltage. Only when the DC voltage generated by the DC power supply is no lower than the predetermined lower limit voltage is the door lock mechanism activating device energized by the DC power supply to lock and unlock the door of the refrigerator in accordance with the command signal.

10 Claims, 2 Drawing Sheets

19, MICROCOMPUTER
27, TRANSMISSION CONTROL CIRCUIT
VOLTAGE INDICATING MEANS AND TIMER
29
21
CPU
ROM
23
RAM
25
INPUT PORT
35
OUTPUT PORT
31
OUTPUT PORT
33
55, DETECTING SWITCH
57
59
RESISTOR, 39
47, RESISTOR
49
ELECTRO-MAGNETIC SOLENOIDS
45
TRANSISTORS
43
37
4, D.C. POWER SOURCE
53, RESISTOR
13, CAPACITOR

METHOD OF CONTROLLING AND CONTROLLER FOR A REFRIGERATOR

This is a continuation of application Ser. No. 07/357,014, filed on May 25, 1989, now abandoned.

BACKGROUND OF THE INVENTION

1. Field of the Invention

The present invention relates, in general, to a refrigerator with a door locking mechanism. More particularly, the invention relates to a refrigerator controller for operating the door locking mechanism of the refrigerator in accordance with a command signal from a host-computer connected therewith.

2. Description of the Prior Art

Guest rooms of lodging facilities such as hotels have recently been furnished with refrigerators which store beverages such as canned or bottled liquor and food so that guests can enjoy them as they desire. Many lodging facilities have adopted central control systems to centrally administer refrigerators in guest rooms. Refrigerators in guest rooms are connected with a host-computer at a front desk, for example, through a bidirectional transmission line and are controlled thereby. Data concerning the number and kind of goods taken from each refrigerator is sent to the host-computer through the bidirectional transmission line. The guest, when he checks out, pays his food and drink charges which the host-computer calculates from the data at the front desk.

Differing from a refrigerator for home use, the refrigerators in guest rooms are usually provided with door locking mechanisms for preventing beverages and food, refrigerated in a guest room where no one checks in, from being taken out fraudulently. The door locking mechanism of each refrigerator is also controlled by the host-computer with each refrigerator receiving a lock or an unlock command signal through the bidirectional transmission line from the host-computer. The guest can open a door of each refrigerator only when the host-computer sends the unlock command signal thereto through the bidirectional transmission line. The period of time during which the host-computer generates the lock or the unlock command signal is previously determined by an administrator of the lodging facility.

An example of such a central control system for refrigerators with a door locking mechanism is disclosed in Japanese Utility Model Publication No. 59-12671, filed Nov. 29, 1979 in the name of Satoru Hibino. In Japanese Utility Model Publication No. 59-12671, each refrigerator in a guest room is connected with a central administering device including a microprocessor through a bidirectional transmission line. Each refrigerator is also provided with a door locking mechanism comprising an electromagnetic solenoid. When an unlock command signal is received from the central administrating device through the bidirectional transmission line, the electromagnetic solenoid is energized and a door of the refrigerator is kept unlocked. Accepting a lock command signal causes the electromagnetic solenoid to deenergize and the door is kept locked. Energizing the electromagnetic solenoid of the door locking mechanism is performed with a DC power transformer supplying DC power thereto. From the standpoint of decreasing production cost, it is desirable for the capacity of DC power transformer to be designed so that the DC power transformer can supply such an amount of DC power to the electromagnetic solenoid that the electromagnetic solenoid generates a holding force which is enough to keep the door in an unlocked or locked condition. The holding energy for the electromagnetic solenoid is generated by a steady state current flowing therethrough.

As is well known, however, the instantaneous current initially flowing through an electromagnetic solenoid is larger than the steady-state current flowing therethrough after initial energization. Therefore, the power supply voltage which is supplied to the electromagnetic solenoid from the DC power transformer may drop to an unacceptably low value as a result of the initial current drawn by the solenoid and the driving force necessary for the electromagnetic solenoid to change the state of the door cannot be obtained.

In order to solve this problem, in the prior art central control system for refrigerators with a door locking mechanism, the DC power transformer in each refrigerator had to be designed to have a larger capacity than necessary for steady-state operation.

SUMMARY OF THE INVENTION

It is an object of the present invention to provide a refrigerator controller which can positively lock and unlock a door of a refrigerator in accordance with a command signal from a host-computer connected therewith.

To accomplish the object described above, the present invention provides a refrigerator controller including a door locking mechanism activating device, a DC power supply device, a voltage indicating device, and a processing device. The door locking mechanism activating device is energized by the DC power supply device to lock and unlock the door. The DC power supply device is charged by a DC power source. The voltage indicating device generates an operation allowance signal when the DC voltage generated by the DC power supply device achieves at least a predetermined lower limit voltage which will positively operate the door locking mechanism activating device. The processing device permits the door locking mechanism activating device to be energized by the DC power supply device in accordance with the command signal only when the operation allowance signal is generated by the voltage indicating device.

BRIEF DESCRIPTION OF THE DRAWINGS

The present invention is best understood with reference to accompanying drawings in which.

DETAILED DESCRIPTION OF THE PREFERRED EMBODIMENT

Referring to the accompanying drawings, an embodiment of the present invention will be described.

Figure 2:
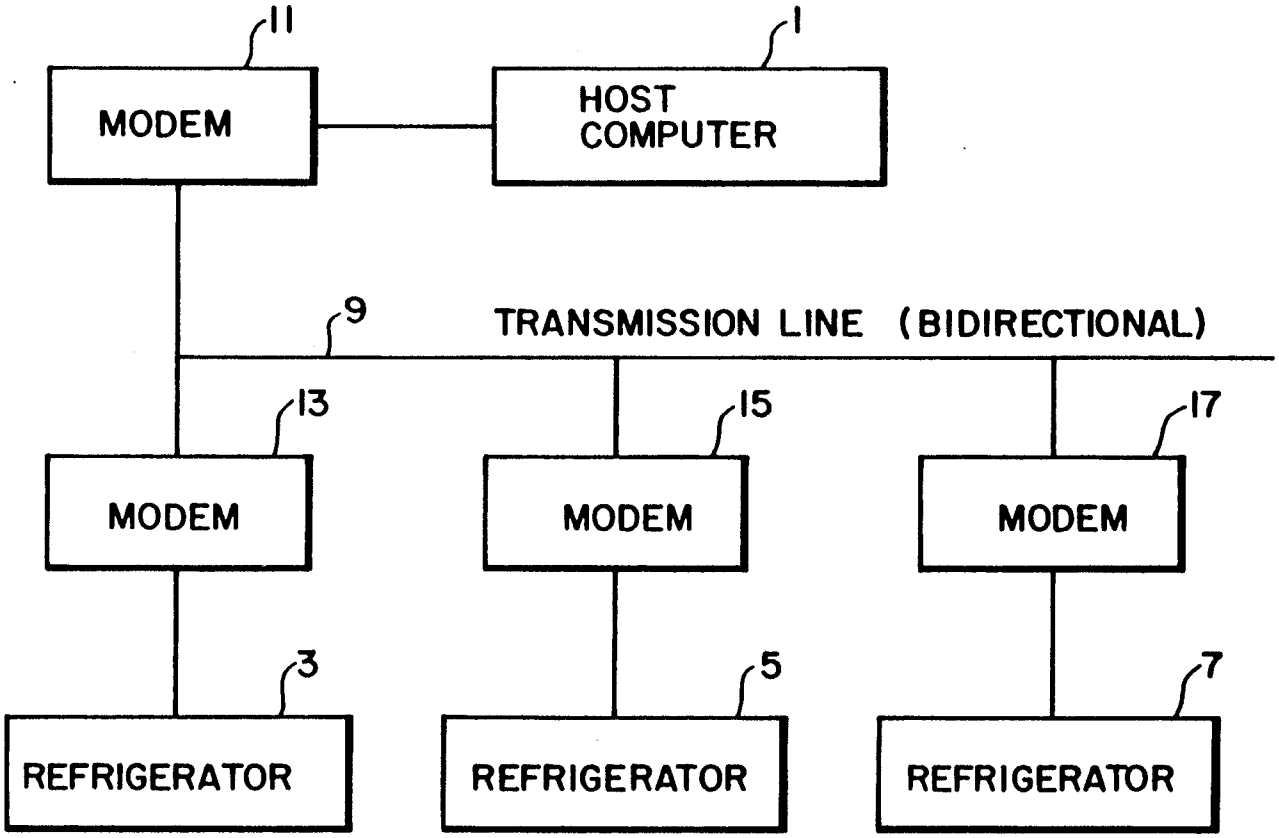
FIG. 2 is a schematic block diagram illustrating a connecting relation between several refrigerators and a host-computer in the embodiment of the invention.

As is shown in FIG. 2, host-computer 1, placed at a reception desk of a hotel, for example, is connected with plural refrigerators 3, 5 and 7 in respective guest rooms of the hotel through a bidirectional transmission line 9 via modems 11, 13, 15 and 17. Host-computer 1 receives data on the kinds and numbers of goods taken from each refrigerator 3, 5 and 7 through bidirectional transmission line 9 and calculates drink and food charges with respect to each refrigerator 3, 5 and 7. Further, host-computer 1 sends door lock and unlock command signals to refrigerators 3, 5 and 7 through bidirectional transmission line 9 according to the condition of each guest room. For example, if guests are staying in the guest room where refrigerator 3 is installed and no guests are staying in the guest rooms where refrigerator 5 and refrigerator 7 are installed, host-computer 1 sends the door unlock command signal to refrigerator 3 and the door lock command signal to refrigerators 5 and 7. Consequently, a door of refrigerator 3 is kept unlocked and doors of refrigerators 5 and 7 are kept locked. For an appropriate period of time when beverages and food are put into a refrigerator, host-computer i also sends the door unlock command signal to the refrigerators.

Figure 1:
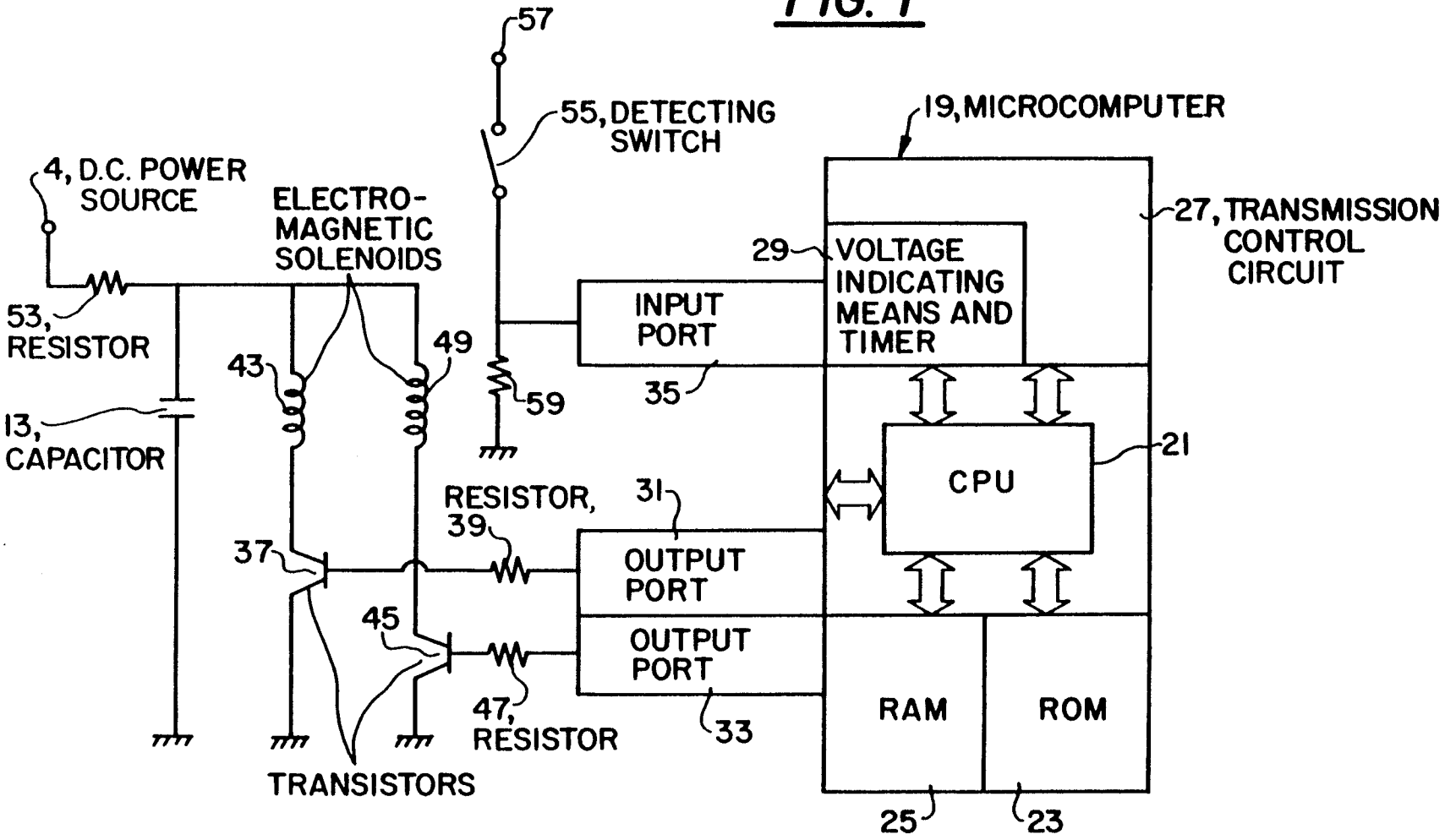
FIG. 1 is a schematic circuit diagram of an embodiment of the invention.

FIG. 1 illustrates a part of an electrical circuit for each refrigerator 3, 5 and 7 which relates to the subject matter of the invention.

Since each refrigerator 3, 5 and 7 has the same electrical circuit as is shown in FIG. 1 the following will be described with respect to refrigerator 3.

Microcomputer 19 includes CPU (Central Processing Unit) 21, ROM (Read Only Memory) 23, RAM (Random Access Memory) 25, transmission control circuit 27, voltage indicator and timer 29, first output port 31, second output port 33, and input port 35. A base of first NPN transistor 37 is connected with first output port 31 of microcomputer 19 through resistor 39, while an emitter thereof is connected to a ground line. A collector thereof is connected to first DC power supply 41 through first electromagnetic solenoid 43. Similarly, a base of second NPN transistor 45 is connected with second output port 33 of microcomputer 19 through resistor 47, while an emitter thereof is connected to the ground line. A collector thereof is connected to first DC power supply 41 through second electromagnetic solenoid 49. Capacitor 51 is connected in parallel with the serial circuit of first electromagnetic solenoid 43 and first NPN transistor 37 and the serial circuit of second electromagnetic solenoid 49 and second NPN transistor 45. Capacitor 51 has one end connected to the ground line and the other end connected to first DC power supply 41 through charging resistor 53. Door condition detecting switch 55 is connected between second DC power supply 57 and the ground line through resistor 59. A connection point of door condition detecting switch 55 and resistor 59 is connected with input port 35 of microcomputer 19.

First electromagnetic solenoid 43, when energized, moves a lock pin of a door locking mechanism (not shown) to keep the door of refrigerator 3 locked. Second electromagnetic solenoid 49, when energized, moves the lock pin of a door locking mechanism (not shown) to keep the door of refrigerator 3 unlocked. Door condition detecting switch 55 comprises a microswitch which is opened or closed in accordance with movement of the lock pin. In this embodiment, for example, door condition detecting switch 55 is closed when the lock pin moves to lock the door of refrigerator 3, and is opened when the door lock pin moves to unlock the door thereof. First and second DC power supplies 41 and 57 are supplied with DC power by a DC power transformer (not shown) of refrigerator 3. If the lock pin is to be positively moved, first and second electromagnetic solenoids 43 and 49 must be supplied with a DC voltage no lower than the lower limit of the driving voltage Vs when they are energized. Lower limit driving voltage Vs is the sum of the voltage drop between the emitter and the collector of each NPN transistor 37 and 45 and the lowest voltage which can cause first or second electromagnetic solenoid 43 or 49 to move the lock pin. Capacitor 51 has such a capacitance that terminal voltage Vc thereof becomes no lower than the lower limit driving voltage Vs when either solenoid 43 or 49 is energized while capacitor 51 is fully charged.

A charging period T, necessary for capacitor 51 to be fully charged, depends on the resistance of charging resistor 53 and the capacity of capacitor 51. Timer 29 in microcomputer 19 is previously set to measure this period and to send an operation allowance signal to CPU 21 at the time the charging period T has passed.

When refrigerator 3 is supplied with electrical power, capacitor 51 starts to be charged through charging resistor 53 from first DC power supply 41. Therefore the terminal voltage Vc increases. Timer 29 also starts counting and sends the operation allowance signal to CPU 21 when timer 29 measures a time period corresponding to the charging period. By this time, as is mentioned above, the charging period T has passed and capacitor 51 has been fully charged, whereby the terminal voltage Vc of capacitor 51 has been increased to be no lower than lower limit driving voltage Vs.

After the operation allowance signal is generated by timer 29, CPU 21 sets first output port or terminal 31 of microcomputer 19 to a high level for a predetermined period of time upon receiving the door lock command signal from host-computer 1 through bidirectional transmission line 9 and transmission control circuit 27 in microcomputer 19. As a result, a turn-on or operation signal having the predetermined duration is supplied to the base of first NPN transistor 37 through resistor 39 from first output port 31 of microcomputer 19. Accordingly, first NPN transistor 37 is turned on for the predetermined period of time, during which period first electromagnetic solenoid 43 is energized by being supplied with DC power from capacitor 51. Therefore, the lock pin is operated to lock the door of refrigerator 3.

When CPU 21 receives the door unlock command signal through bidirectional transmission line 9 and transmission control circuit 27 in microcomputer 19, CPU sets second output port or terminal 33 at a high level for the predetermined period of time, assuming that the operation allowance signal is generated by timer 29. As a result, the turn-on or operation signal having predetermined duration is supplied to the base of second NPN transistor 45 through resistor 47 from second output port 33 of microcomputer 19. Accordingly, second NPN transistor 45 is turned on for the predetermined period of time, during which second electromagnetic solenoid 49 is energized by being supplied with DC power from capacitor 51. Therefore, the locking pin operated to unlock the door of refrigerator 3.

When the turn-on signal is output from microcomputer 19, timer 29 is reset by CPU 21 and stops counting.

Both of first and second electromagnetic solenoids 43 and 49 are provided with a self-holding function. The door of refrigerator 3 is kept locked and unlocked in accordance with the door lock and unlock command signal from host-computer 1 even after the predetermined period of time has passed and the turn-on signal from microcomputer 19 has ended.

When the turn-on signal from microcomputer 19 ends, timer 29 starts counting again.

Since both the first and second electromagnetic solenoids 43 and 49 are not energized until the charging period T has passed and the terminal voltage Vc of capacitor 51 has accordingly increased to be no lower than the lower limit driving voltage Vs, first and second electromagnetic solenoids 43 and 49, when energized, can be supplied with sufficient DC power to positively move the lock pin of the door locking mechanism.

A door condition detecting signal from door condition detecting switch 55 is input to CPU 21 through input port 35 of microcomputer 19. As is mentioned above, door condition detecting switch 55 is closed when the lock pin is in the position to lock the door of refrigerator 3, while door condition detecting switch 55 is opened when the lock pin is in the position to unlock the door of refrigerator 3. Therefore, the door condition detecting signal becomes high when the door of refrigerator 3 is kept locked, while the door condition detecting signal becomes low when the door thereof is kept unlocked.

CPU 21 detects the door condition detecting signal after a preset time has passed after the turn-on signal was generated from microcomputer 19 to determine whether or not the door lock pin has positively moved in accordance with the door lock/unlock command signals from host-computer 1.

If the door condition detecting signal does not become high before the preset time has passed, since the turn-on signal was generated and applied to the base of first NPN transistor 37, CPU 21 judges that first electromagnetic solenoid 43 failed to move the lock pin appropriately. CPU 21 then sets first output port 31 high level again after the operation allowance signal is sent thereto from timer 29, whereby first NPN transistor 37 is turned on again and first electromagnetic solenoid 43 is again energized.

Similarly, if the door condition detecting signal does not become low before the preset time has passed since the turn-on signal was generated to the base of second NPN transistor 45, CPU 21 judges that second electromagnetic solenoid 49 failed to move the lock pin appropriately, and sets second output port 33 at a high level again after the operation allowance signal is sent thereto from timer 29. Second NPN transistor 45 is turned on again and second electromagnetic solenoid 49 is again energized When a second energization is required, since both of first and second electromagnetic solenoids 43 and 49 are not energized until the charging period T has passed and the terminal voltage Vc of capacitor 51 has accordingly increased to be no lower than lower limit driving voltage Vs, first and second electromagnetic solenoids 43 and 49 when energized, can be supplied with DC power enough to positively move the lock pin of the door locking mechanism. Moreover, since capacitor 51 is free from being discharged repeatedly in response to the door condition detecting signal before the terminal voltage Vc thereof raises above the lower limit driving voltage Vs, first and second electromagnetic solenoids 43 and 49 can be kept from permanently failing to move the lock pin.

CPU 21 also performs a second function in response to the door condition detecting signal from switch 55. As indicated above, CPU 21 outputs turn-on signals in response to commands from host-computer 1. However, the turn-on signals are generated only when the command from host-computer 1 does not match the condition of the door lock as indicated by the door condition detecting signal. That is, if the door is already locked (or unlocked) and a command is received to lock (or unlock) the door, CPU 21 will not generate the appropriate turn-on signal.

As is well understood from the above description, in this embodiment, since it is not until the terminal voltage Vc of capacitor 51 becomes greater than the lower limit driving voltage Vs that first and second electromagnetic solenoids 43 and 49 are energized, first and second electromagnetic solenoids 43 and 49, can positively move the lock pin of the door locking mechanism in accordance with the door lock/unlock command signals from host-computer 1. Furthermore, compared with the prior art, a cheaper and smaller DC power transformer, which has so small a capacity that if it were included without capacitor 51, the voltage generated thereby could be momentarily reduced below the lower limit driving voltage Vs by the initial current flowing through first or second electromagnetic solenoids 43 or 49, can be adopted as the DC power transformer of each refrigerator.

The present invention has been described with respect to a specific embodiment. However, other embodiments based on the principles of the invention should be obvious to those of ordinary skill in the art. For example, instead of timer 29 in microcomputer 19, a charging voltage indicating circuit which comprises a comparator for directly comparing the terminal voltage Vc of capacitor 51 with lower limit driving voltage Vs may be used. Moreover, microcomputer 19 may be provided with an external timer or a CR time constant circuit instead of internal timer 29.

Such embodiments are intended to be covered by the claims.

What is claimed is:

1. A refrigerator with a controller including a transmission circuit to receive a command signal from a host-computer external to and electrically connected therewith, comprising:

at least one refrigerator having a door;

electronic lock means for activating a door lock mechanism to lock a door of the refrigerator;

electronic unlock means for activating the door lock mechanism to unlock the door of the refrigerator;

power supply means for energizing the electronic lock means and the electronic unlock means with a DC voltage, the power supply means being charged by a DC power source;

voltage indicating means for generating an operation allowance signal when the power supply means is charged to generate a DC voltage no lower than a predetermined lower limit DC voltage below which at least the electronic lock means and the electronic unlock means can not operate the door lock mechanism;

switching means for permitting the power supply means to energize the electronic lock means and the electronic unlock means; and processing means for operating the switching means in accordance with the command signal only after the operation allowance signal is generated by the voltage indicating means;

wherein said power supply means includes a capacitor between the DC power source and a ground line, the DC voltage stored thereon being no lower than the predetermined lower limit voltage when the capacitor is fully charged; and wherein the voltage indicating means includes a timer, the operation allowance signal being generated when the capacitor is fully charged.

2. A refrigerator controller according to claim 1, wherein the processing means includes an output terminal, an operation signal being output therefrom to the switching means.

3. A refrigerator controller according to claim 2, wherein the electronic lock means and the electronic unlock means each include an electromagnetic solenoid for activating the door lock mechanism to lock and unlock the door of the refrigerator.

4. A refrigerator controller according to claim 3, wherein the switching means includes a transistor to be turned on and off in accordance with the operation signal, an emitter thereof being connected to the ground line, a collector thereof being connected with the power supply means through the electromagnetic solenoid, a base thereof being connected with the output terminal of the processing means.

5. A refrigerator controller according to claim 1 further including a door condition detecting means for generating a door condition signal in response to a condition of the door, the door condition signal being applied to the processing means.

6. A refrigerator controller according to claim 5, wherein the processing means includes an input terminal to which the door condition signal is input, the processing means operating the switching means when the door condition signal corresponding to the command signal is not input thereto.

7. A refrigerator controller according to claim 5, wherein the processing means includes an input terminal to which the door condition signal is input.

8. A refrigerator controller according to claim 1, wherein the processing means further includes an output terminal, an operation signal being output therefrom to the switching means.

9. A refrigerator controller according to claim 8, wherein the electronic lock means and the electronic unlock means each include an electromagnetic solenoid for activating the door lock mechanism to lock and unlock the door of the refrigerator.

10. A refrigerator controller according to claim 9, wherein the switching means includes a transistor to be turned on and off in accordance with the operation signal, an emitter thereof being connected to the ground line, a collector thereof being connected with the power supply means through the electromagnetic solenoid, a base thereof being connected with the output terminal of the processing means.

* * * * *